US006735837B2

(12) United States Patent
Pum

(10) Patent No.: US 6,735,837 B2
(45) Date of Patent: May 18, 2004

(54) APPARATUS FOR NEEDLING A NON-WOVEN MATERIAL

(75) Inventor: Hannes Pum, Alberndorf (AT)

(73) Assignee: Textilmaschinenfabrik Dr. Ernst Fehrer Aktiengesellschaft, Leonding (AT)

( * ) Notice: Subject to any disclaimer, the term of this patent is extended or adjusted under 35 U.S.C. 154(b) by 0 days.

(21) Appl. No.: 10/157,943

(22) Filed: May 29, 2002

(65) Prior Publication Data

US 2003/0056347 A1 Mar. 27, 2003

(30) Foreign Application Priority Data

Jun. 12, 2001 (AT) ..... 904/2001

(51) Int. Cl.[7] ..... D04H 18/00
(52) U.S. Cl. ..... 28/114; 28/107
(58) Field of Search ..... 28/114, 113, 107, 28/115, 111, 112, 109, 110, 103

(56) References Cited

U.S. PATENT DOCUMENTS

| | | | | | |
|---|---|---|---|---|---|
| 3,845,529 | A | * | 11/1974 | Van Deusen et al. | 28/114 |
| 3,916,494 | A | * | 11/1975 | Konig | 28/107 |
| 4,856,152 | A | * | 8/1989 | Kis | 28/114 |
| 4,977,653 | A | * | 12/1990 | Pum | 28/115 |
| 5,148,584 | A | * | 9/1992 | Fehrer | 28/115 |
| 5,511,294 | A | * | 4/1996 | Fehrer | 28/113 |
| 5,513,423 | A | * | 5/1996 | Jakob et al. | 28/114 |
| 5,699,595 | A | * | 12/1997 | Feyerl | 28/114 |
| 5,732,453 | A | * | 3/1998 | Dilo et al. | 28/114 |
| 5,896,633 | A | * | 4/1999 | Fehrer | 28/107 |
| 6,161,269 | A | * | 12/2000 | Dilo et al. | 28/114 |
| 2002/0066169 | A1 | * | 6/2002 | Legl | 28/107 |
| 2003/0097740 | A1 | * | 5/2003 | Jourde et al. | 28/107 |

FOREIGN PATENT DOCUMENTS

| | | |
|---|---|---|
| DE | 19615697 | 3/1997 |
| EP | 0892102 | 1/1999 |

* cited by examiner

*Primary Examiner*—Amy B. Vanatta
(74) *Attorney, Agent, or Firm*—Collard & Roe, P.C.

(57) ABSTRACT

An apparatus is described for needling a non-woven material with a guide means (16) for the non-woven material between a perforated base plate (17) and a perforated stripping plate (18) as well as at least one needleboard (2) which is disposed on the side of the stripping plate (18) averted from the base plate (17) and is drivable in a reciprocating manner both in the needle penetration direction as well as the direction of passage (4, 15) of the non-woven material. In order to provide advantageous constructional conditions it is proposed that the base plate (17) and the stripping plate (18) are drivable synchronously with respect to the needleboard (2) in the direction of passage (15) of the non-woven material.

1 Claim, 1 Drawing Sheet

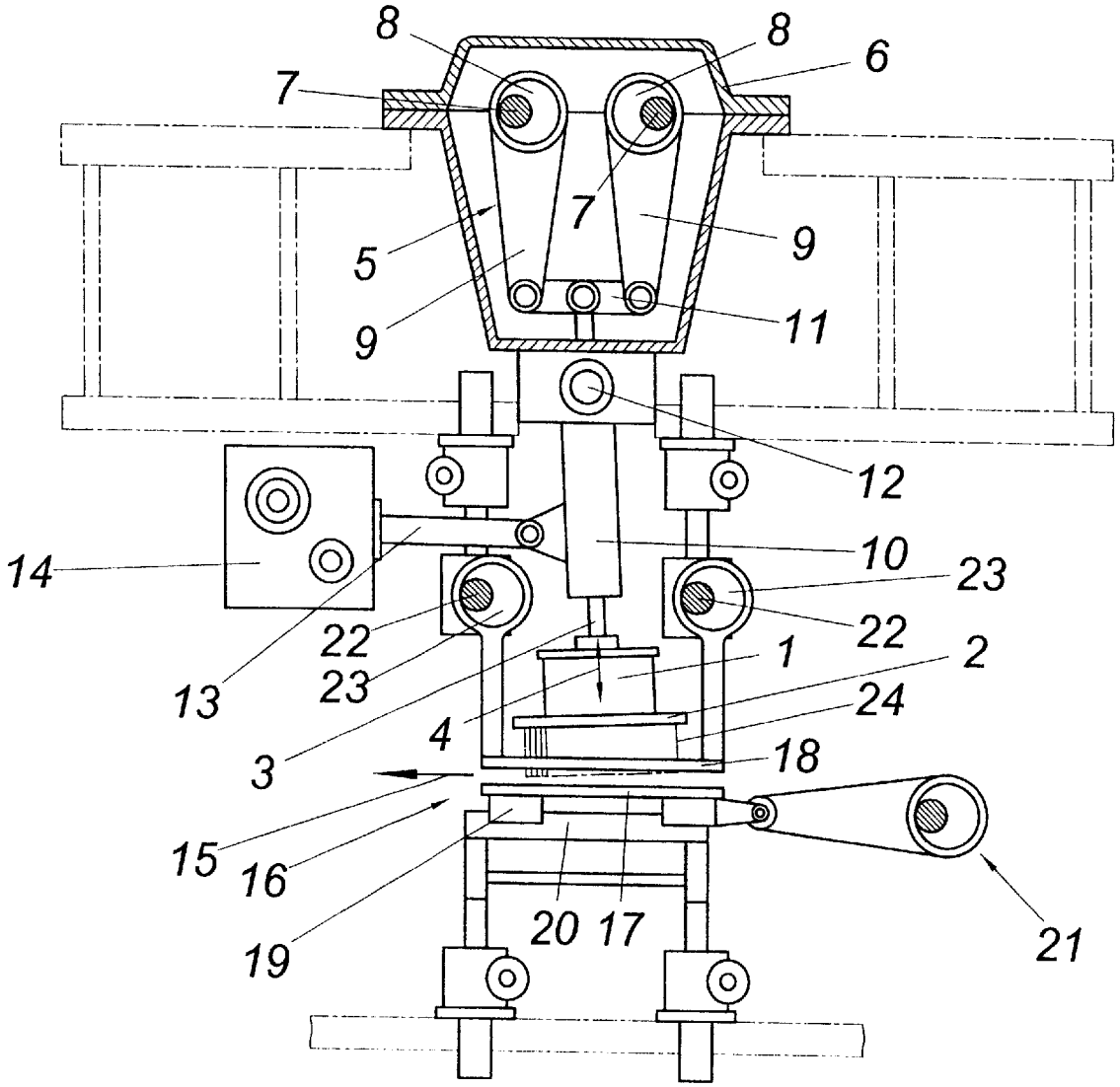
21
23
2
6
12
10
22
24
8
9
11
1
18
7
17
20
4
8
5
9
22
23
7
3
16
19
13
15
14

APPARATUS FOR NEEDLING A NON-WOVEN MATERIAL

FIELD OF THE INVENTION

The invention relates to an apparatus for needling a non-woven material with a guide means for the non-woven material between a perforated base plate and a perforated stripping plate and at least one needleboard which is disposed on the side of the stripping plate averted from the base plate and is drivable in a reciprocating manner both in the needle penetration direction as well as the direction of passage of the non-woven material.

DESCRIPTION OF THE PRIOR ART

In order to increase the advance of the non-woven material it is known (DE 196 15 697 A1, EP 0 892 102 A2) to additionally provide a needleboard drive which reciprocates in the direction of passage of the non-woven material, so that the advance of the non-woven material is increased by the movement component of the needleboard in the direction of passage of the non-woven material. The needleboard movement in the direction of passage of the non-woven material during the needle engagement in the non-woven material allows a respective advance movement of the non-woven material. In the construction of the guide means for the non-woven material between a base plate opposite of the needleboard and a stripping plate disposed between the base plate and the needleboard one must take the movement component of the needles in the direction of passage of the non-woven material into account. This means that both the base plate as well as the stripping plate need to be provided with oblong holes for the needle passage which are aligned in the direction of passage of the non-woven material, which not only increases the amount of work for producing said pass-through holes but also entails the additional disadvantage that the mutual needle distance is increased at least in the direction of passage of the non-woven material and it is thus necessary to decrease the number of needles of the needleboard.

SUMMARY OF THE INVENTION

The invention is thus based on the object of providing an apparatus for needling a non-woven material of the kind mentioned above in such a way that the needles of the needleboard can be arranged in a distribution density which correspond to the higher distribution density of the needles of needleboards which are exclusively drivable in a reciprocating manner in the needle penetration direction as a result of the tight arrangement of circular needle pass-through holes in the base and stripping plate.

This object is achieved in accordance with the invention in such a way that the base plate and the stripping plate are held movably in the direction of passage of the non-woven material and can be driven synchronously with respect to the needleboard.

Since as a result of this measure a relative movement of the needleboard with respect to the base and stripping plate in the direction of passage of the non-woven material is substantially prevented, it is possible to provide both in the base plate as well as stripping plate circular pass-through holes for the needles of the needleboard in a tight arrangement which merely depends on the strength of said plates but not on the needle movement in the direction of passage of the non-woven material. This creates the conditions as apply to conventional needling apparatuses without drive in the direction of passage of the non-woven material, so that with the higher distribution density of the needles it is possible to advantageously influence not only the needleboard size but also an even needling of the non-woven material. Notice should be taken in this connection that for a respective distribution density of the needles, the base and stripping plate could also be provided with oblong holes extending in the direction of passage of the non-woven material if two or more needles pass through said oblong holes, so that again the synchronous movement of said plates with the needleboard in the direction of passage of the non-woven material can be utilized advantageously for a higher distribution density of the needles. The synchronization of the movements of the needleboard and the base and stripping plate in the direction of passage of the non-woven material need not necessarily lead to any precise correspondence of the movement components in the direction of passage of the non-woven material as long as the differences in movement as are caused by the drive do not impair the needle passage through the pass-through holes in the stripping and base plate.

In order to provide simple constructional conditions for the reciprocating drive of the base plate the base plate may be part of a carriage which is displaceably held in the direction of passage of the non-woven material, with an eccentric drive acting upon said carriage which must obviously be driven in synchronicity with the needleboard drive for the needleboard movement in the direction of passage of the non-woven material.

The stripping plate could also be held in a sliding guide means. More favorable return motion conditions can be obtained, however, when the stripping plate is held on the eccentrics of two parallel eccentric shafts which are disposed in the direction of passage of the non-woven material in front of and behind the needleboard, because in this case the stripping plate can be lifted off from the non-woven material during the return motion following the advancing motion, which facilitates the advancement of the non-woven material during the return of the guide means of the non-woven material.

BRIEF DESCRIPTION OF THE DRAWINGS

The drawing shows the subject matter of the invention by way of example. An apparatus in accordance with the invention for needling a non-woven material is shown schematically in a partly elevated side view.

DESCRIPTION OF THE PREFERRED EMBODIMENT

The illustrated apparatus for needling a non-woven material is provided with a needleboard 2 which is provided on a needle beam 1 and is reciprocatingly drivable via pushrods 3 in the needle penetration direction 4, namely via an eccentric drive 5 which consists of two eccentric shafts 7 which are rotatably held in a housing 6 and on whose eccentrics 8 connecting rods 9 are held. The push rods 3 which are guided in an axially displaceably way in guide sleeves 10 act on the couplings 11 connecting the connecting rods 9 of the two eccentric shafts 7. The guide sleeves 10 are swivelably held about a swivel pin 12 which is parallel to the eccentric shafts 7. A drag-link rod 13 can be used to drive the guide sleeves 10 oscillatingly back and forth by a gear 14 about a central position in the direction of passage 15 of the non-woven material.

A guide means 16 is provided for the non-woven material to be needled, which guide means consists of a base plate 17 opposite of the needleboard 2 and a stripping plate 18 disposed between the base plate 17 and the needleboard 2. In contrast to conventional guide means 16 with plates 17 and 18 which are fixed to the frame, both the base plate 17 and the stripping plate 18 are held in an adjustable manner in the direction of passage 15 of the non-woven material. For this purpose the base plate 17 forms a part of the carriage 19 which is held on a sliding guide means 20 and can be driven with the help of an eccentric drive 21 in synchronicity with the oscillating drive of the needleboard 2.

The stripping 18 is also driven in a reciprocating fashion synchronously with the advancing movement of the needleboard 2 in the direction of passage 15 of the non-woven material. However, this occurs via two parallel eccentric shafts 22 on whose eccentrics 23 the stripping plate 18 is held which thus takes part in the circular motion of the eccentric 23. This means that the stripping plate 18 is not only driven reciprocatingly in the direction of passage 15 of the non-woven material but also in the direction of needle penetration 4, so that the stripping plate 18 lifts off the non-woven material during the return motion against the direction of passage 15 of the non-woven material and thus facilitates the advancement of the non-woven material.

Since the amplitude of the reciprocating movements both of the needles 24 of the needleboard 2 as well as the base plate 17 and the stripping plate 18 correspond in the direction of passage 15 of the non-woven material, the pass-through holes for the needles 24 of the needleboard 2 as provided for in the base plate 17 and in the stripping plate 18 can be provided with a circular arrangement without having to take into account the joint reciprocating movement of the needles 24 and the plates 17 and 18 in the direction of passage 15 of the non-woven material because no relative movement is obtained between said constructional parts in the direction of passage of the non-woven material apart from the slight swiveling adjustment of the needles 24 about the swivel pin 12. Notice should be taken in this connection that the eccentricities of the eccentrics 23 of the eccentric shafts 22 or the eccentric drive 21 are shown on an excessively large scale in order to clarify the drive conditions.

Due to the synchronous reciprocating movement of the needles 24 and the plates 17, 18 of the guide means 16 in the direction of passage 15 of the non-woven material, the pass-through holes in the plates 17 and 18 for the needles 24 can be arranged in a distribution density which is achieved otherwise only in needleboards which are driven reciprocatingly only in the direction of needle penetration, which has a direct effect on a more even needling of the non-woven material.

It is understood that the invention is not limited to the illustrated embodiment. The needleboard drive in the direction of passage 15 of the non-woven material can be solved in different constructional ways, as there are different constructional solutions for drives of the guide means 16 which reciprocate in the direction of passage of the non-woven material. The relevant aspect is merely that the needleboard 2 with the needles 24 on the one hand and the plates 17 and 18 of the guide means 16 on the other hand are driven synchronously in a reciprocating fashion in the direction of passage 15 of the non-woven material in order to avoid having to take into account during the reciprocating needleboard movement in the direction of passage 15 any relative movements of the needles with respect to the guide means 16 in the direction of passage 15 which would impair the distribution density of the needles 24.

What is claimed is:

1. An apparatus for needling a non-woven material, comprising (a) a guide means comprised of a perforated base plate and a perforated stripping plate wherebetween the non-woven material is passed, (1) the base plate and the stripping plate being held movably in a direction of passage of the non-woven material, (b) a carriage displaceably held in the direction of passage of the non-woven material, the base plate being part of the carriage, (c) an eccentric drive acting on the carriage, (d) two parallel eccentric shafts disposed in the direction of passage of the non-woven material, and (e) at least one needleboard disposed on a side of the stripping plate averted from the base plate, (1) the at least one needleboard being drivable in a reciprocating manner in a needle penetration direction and in a direction of passage of the non-woven material, (2) the stripping plate being held on eccentrics of the eccentric shafts, which are disposed in front of and behind the needleboard, and the base plate and the stripping plate being drivable synchronously with respect to the needleboard, and the stripping plate being movable with respect to the base plate in the needle penetration direction.

* * * * *